US010062314B2

(12) United States Patent
Lee et al.

(10) Patent No.: US 10,062,314 B2
(45) Date of Patent: Aug. 28, 2018

(54) ELECTRONIC DEVICE AND METHOD FOR CONTROLLING DISPLAY IN ELECTRONIC DEVICE

(71) Applicant: Samsung Electronics Co., Ltd., Suwon-si, Gyeonggi-do (KR)

(72) Inventors: Hong-Kook Lee, Seoul (KR); Hyun-Chang Shin, Seongnam-si (KR); Dong-Sub Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 39 days.

(21) Appl. No.: 15/082,581

(22) Filed: Mar. 28, 2016

(65) Prior Publication Data

US 2016/0284264 A1 Sep. 29, 2016

(30) Foreign Application Priority Data

Mar. 27, 2015 (KR) ..... 10-2015-0043241

(51) Int. Cl.
*G09G 5/39* (2006.01)
*G09G 3/20* (2006.01)

(52) U.S. Cl.
CPC ..... *G09G 3/2092* (2013.01); *G09G 2320/103* (2013.01); *G09G 2330/022* (2013.01); *G09G 2340/0435* (2013.01); *G09G 2360/18* (2013.01)

(58) Field of Classification Search
CPC ..... G09G 3/2092; G09G 2360/18; G09G 2340/0435; G09G 2330/022; G09G 2320/103; G09G 5/393; G09G 5/39; G09G 5/363; G09G 5/395; G09G 2350/00; G09G 2330/021; G09G 2340/02; G09G 2360/127; G09G 2310/08; G09G 5/006; G09G 2310/0264; G09G 2310/027; G09G 2370/10; G09G 2352/00; G06T 1/60; H04N 9/8205; H04N 9/8227; H04N 13/0029; H04N 9/7921
See application file for complete search history.

(56) References Cited

U.S. PATENT DOCUMENTS

2010/0231285 A1 9/2010 Boomer et al.
2012/0206461 A1* 8/2012 Wyatt ..... G09G 5/003 345/501
2013/0187937 A1* 7/2013 Kerofsky ..... G09G 3/20 345/530
2015/0243253 A1* 8/2015 Sone ..... G09G 3/2096 345/209
2015/0264298 A1* 9/2015 Colenbrander ..... H04N 7/013 345/547
2016/0189333 A1* 6/2016 Morein ..... G09G 3/00 345/555

* cited by examiner

*Primary Examiner* — Xilin Guo
(74) *Attorney, Agent, or Firm* — Jefferson IP Law, LLP

(57) ABSTRACT

A method for controlling display by an electronic device is provided. The method includes, when a predetermined number or more same frame data are consecutively generated, storing the same frame data in a storage of a display driving module by an application processor, stopping transmitting frame data to the display driving module, and scanning the frame data stored in the storage and outputting to a display panel by the display driving module.

10 Claims, 9 Drawing Sheets

ELECTRONIC DEVICE AND METHOD FOR CONTROLLING DISPLAY IN ELECTRONIC DEVICE

CROSS-REFERENCE TO RELATED APPLICATION(S)

This application claims the benefit under 35 U.S.C. § 119(a) of a Korean patent application filed on Mar. 27, 2015 in the Korean Intellectual Property Office and assigned Serial No. 10-2015-0043241, the entire disclosure of which is hereby incorporated by reference.

TECHNICAL FIELD

The present disclosure relates to an apparatus and method for controlling a display in an electronic device.

BACKGROUND

Generally, the term "electronic device" refers to a device for performing a particular function according to its equipped program, such as a home appliance, an electronic scheduler, a portable multimedia player, a mobile communication terminal, a tablet personal computer (PC), a video/sound device, a desktop PC or a laptop computer, a navigation device for an automobile, etc. For example, electronic devices may output stored information as voices or images. As electronic devices are highly integrated and perform at a high-speed, high-volume wireless communication becomes commonplace, mobile communication terminals are recently being equipped with various functions.

For example, an electronic device comes with integrated functionality, including an entertainment function, such as playing video games, a multimedia function, such as replaying music/videos, a communication and security function for mobile banking, and a scheduling or an electronic wallet (e-wallet) function.

An electronic device may have at least one display module for displaying its state or visually providing information. As the size or type of electronic devices is diversified, electronic devices equipped with various types of display modules are coming to market.

The above information is presented as background information only to assist with an understanding of the present disclosure. No determination has been made, and no assertion is made, as to whether any of the above might be applicable as prior art with regard to the present disclosure.

SUMMARY

With the advent of electronic devices equipped with high definition television (HDTV) or higher, which is a trend for ultra HD display modules, there is a need to develop ultra HD mobile display processing devices for wide video graphics array (WVGA) (800×1280) or Full HD (1080×1920) or higher resolution using organic light emitting diodes (OLED) and low temperature poly silicone (LTPS)-liquid crystal display (LCD) techniques. Various solutions for low-power driving of the display driver integrated circuits (ICs) (DDIs) are also needed for reducing power consumption in driving ultra HD mobile displays, reducing heat generated in the products, and reducing a load of application processors (APs) in the products.

Further, recent display system environments require enhancements in high-speed driving capability for addressing significantly increased data volume that is input/output from the mobile AP through the high speed serial interface (HSSI) to the DDI and complementary metal-oxide-semiconductor (CMOS) image sensor (CIS) so as to respond to full HD or other ultra HD standards.

Aspects of the present disclosure are to address at least the above-mentioned problems and/or disadvantages and to provide at least the advantages described below. Accordingly, an aspect of the present disclosure is to provide an electronic device that may be operated at high speed and be easily integrated and a method for controlling a display in the electronic device.

Another aspect of the present disclosure is to provide an electronic device that may reduce power consumption and a method for controlling a display in the electronic device.

In accordance with an aspect of the present disclosure, an electronic device is provided. The electronic device includes an application processor configured to, when at least a predetermined number of same frame data are consecutively generated, transmit the same frame data to a display driving module and stop transmitting frame data to the display driving module, wherein the display driving module is configured to receive the same frame data, store the received frame data, scan the stored frame data, and output the scanned frame data to a display panel.

In accordance with another aspect of the present disclosure, an electronic device is provided. The electronic device includes an application processor configured to, when at least a predetermined number of same frame data are consecutively generated, set a display scan frequency and transmit the same frame data and a display driving module configured to, when receiving the same frame data from the application processor, transfer a sync signal to the application processor whenever outputting the received frame data to a display panel, wherein the application processor may transmit the same frame data to the display driving module according to the display scan frequency by referencing the transferred sync signal until a frame data different from the same frame data is generated by the application processor, wherein a number of periods per one second corresponding to the display scan frequency may be smaller than the number of frame data per one second corresponding to a frame rate.

In accordance with another aspect of the present disclosure, a method for controlling display by an electronic device is provided. The method includes, when at least a predetermined number of same frame data are consecutively generated, storing the same frame data in a storage of a display driving module by an application processor and stopping transmitting of frame data to the display driving module and scanning frame data stored in the storage and outputting the frame data to a display panel by the display driving module.

In accordance with another aspect of the present disclosure, a method for controlling display by an electronic device is provided. The method includes, when at least a predetermined number of same frame data are consecutively generated, setting a display scan frequency and transmitting the same frame data to a display driving module by an application processor, when the same frame data are received, transferring a sync signal to the application processor whenever outputting the received frame data to a display panel by the display driving module and transmitting the same frame data to the display driving module according to the display scan frequency by referencing the transferred sync signal until a frame data different from the same frame data is generated by the application processor, wherein a number of periods per one second corresponding to the display scan frequency may be smaller than the number of frame data per one second corresponding to the frame rate.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
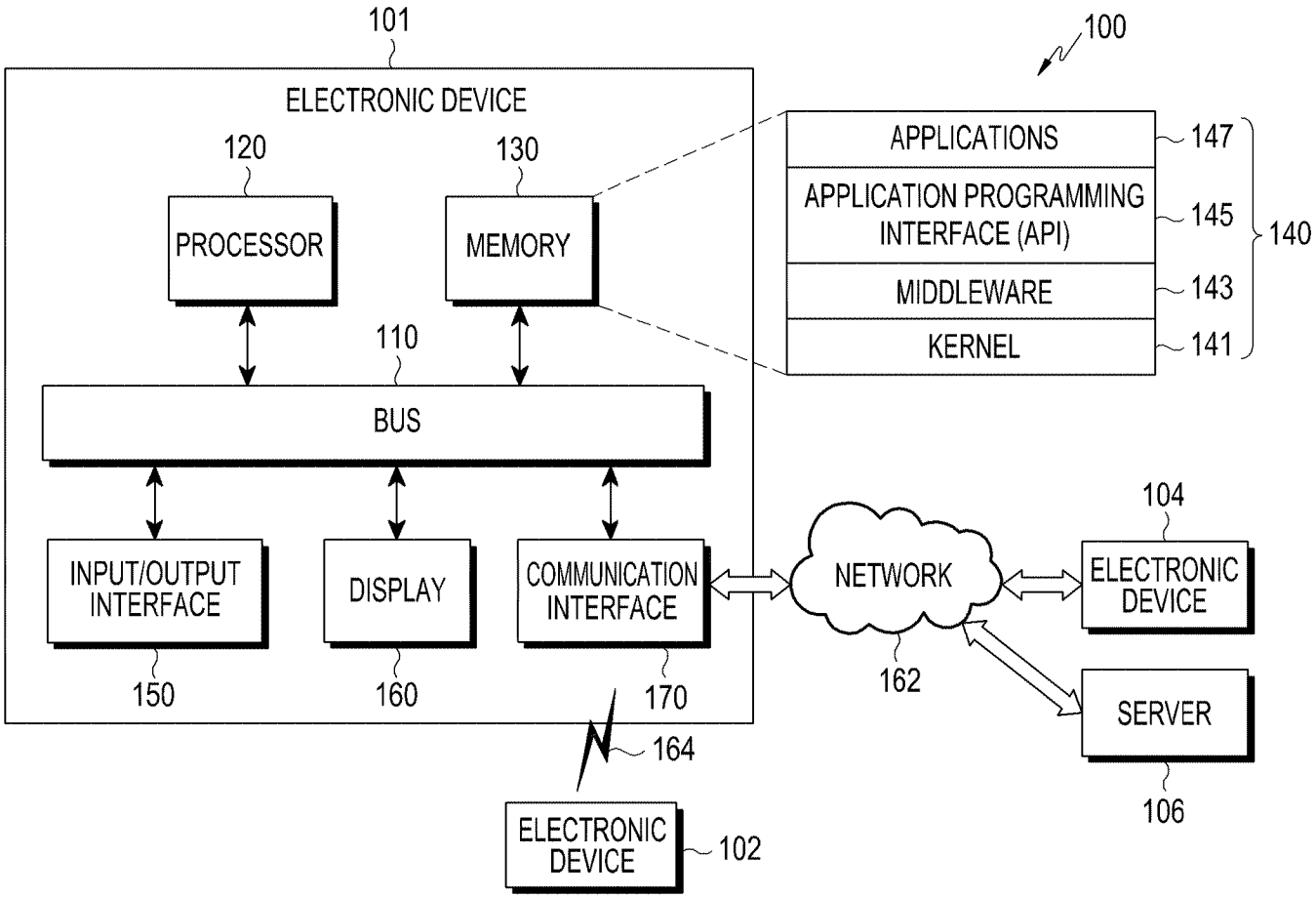
FIG. 1 is a view illustrating a network configuration according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As used herein, the terms "have," "may have," "include," or "may include" a feature (e.g., a number, function, operation, or a component such as a part) indicate the existence of the feature and do not exclude the existence of other features.

As used herein, the terms "A or B," "at least one of A and/or B," or "one or more of A and/or B" may include all possible combinations of A and B. For example, "A or B," "at least one of A and B," "at least one of A or B" may indicate all of (1) including at least one A, (2) including at least one B, or (3) including at least one A and at least one B.

As used herein, the terms "first" and "second" may modify various components regardless of importance and do not limit the components. These terms are only used to distinguish one component from another. For example, a first user device and a second user device may indicate different user devices from each other regardless of the order or importance of the devices. For example, a first component may be denoted a second component, and vice versa without departing from the scope of the present disclosure.

It will be understood that when an element (e.g., a first element) is referred to as being (operatively or communicatively) "coupled with/to," or "connected with/to" another element (e.g., a second element), it can be coupled or connected with/to the other element directly or via a third element. In contrast, it will be understood that when an element (e.g., a first element) is referred to as being "directly coupled with/to" or "directly connected with/to" another element (e.g., a second element), no other element (e.g., a third element) intervenes between the element and the other element.

As used herein, the terms "configured (or set) to" may be interchangeably used with the terms "suitable for," "having the capacity to," "designed to," "adapted to," "made to," or "capable of" depending on circumstances. The term "configured (or set) to" does not essentially mean "specifically designed in hardware to." Rather, the term "configured to" may mean that a device can perform an operation together with another device or parts. For example, the term "processor configured (or set) to perform A, B, and C" may mean a generic-purpose processor (e.g., a central processing unit (CPU) or application processor (AP) that may perform the operations by executing one or more software programs stored in a memory device or a dedicated processor (e.g., an embedded processor) for performing the operations.

All terms including technical and scientific terms used herein have the same meaning as commonly understood by one of ordinary skill in the art to which the embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some cases, the terms defined herein may be interpreted to exclude embodiments of the present disclosure.

For example, examples of the electronic device according to embodiments of the present disclosure may include at least one of a smartphone, a tablet personal computer (PC), a mobile phone, a video phone, an e-book reader, a desktop PC, a laptop computer, a netbook computer, a workstation, a personal digital assistant (PDA), a portable multimedia player (PMP), a Moving Picture Experts Group (MPEG) audio layer 3 (MP3) player, a mobile medical device, a camera, or a wearable device (e.g., smart glasses, a head-mounted device (HMD), electronic clothes, an electronic bracelet, an electronic necklace, an electronic appcessory, an electronic tattoo, a smart mirror, or a smart watch).

According to an embodiment of the present disclosure, the electronic device may be a smart home appliance. For example, a smart home appliance may include at least one of a television (TV), a digital versatile disc (DVD) player, an audio player, a refrigerator, an air conditioner, a cleaner, an oven, a microwave oven, a washer, a dryer, an air cleaner, a set-top box, a home automation control panel, a security control panel, a TV box (e.g., Samsung HomeSync™, Apple TV™, or Google TV™), a gaming console (Xbox™, PlayStation™), an electronic dictionary, an electronic key, a camcorder, or an electronic picture frame.

According to an embodiment of the present disclosure, examples of the electronic device may include at least one of various medical devices (e.g., diverse portable medical measuring devices (a blood sugar measuring device, a heartbeat measuring device, or a body temperature measuring device), a magnetic resource angiography (MRA) device, a magnetic resource imaging (MRI) device, a computed tomography (CT) device, an imaging device, or an ultrasonic device), a navigation device, a global positioning system (GPS) receiver, an event data recorder (EDR), a flight data recorder (FDR), an automotive infotainment device, an sailing electronic device (e.g., a sailing navigation device or a gyro compass), avionics, security devices, vehicular head units, industrial or home robots, automatic teller's machines (ATMs), point of sales (POS) devices, or Internet of things devices (e.g., a bulb, various sensors, an electric or gas meter, a sprinkler, a fire alarm, a thermostat, a street light, a toaster, fitness equipment, a hot water tank, a heater, or a boiler).

According to various embodiments of the present disclosure, examples of the electronic device may at least one of furniture, part of a building/structure, an electronic board, an electronic signature receiving device, a projector, or various measurement devices (e.g., devices for measuring water, electricity, gas, or electromagnetic waves). According to an embodiment of the present disclosure, the electronic device may be one or a combination of the above-listed devices. According to an embodiment of the present disclosure, the electronic device may be a flexible electronic device. The electronic device disclosed herein is not limited to the above-listed devices, and may include new electronic devices depending on the development of technology.

Hereinafter, electronic devices are described with reference to the accompanying drawings, according to various embodiments of the present disclosure. As used herein, the term "user" may denote a human or another device (e.g., an artificial intelligent electronic device) using the electronic device.

FIG. 1 is a view illustrating a network configuration according to an embodiment of the present disclosure.

Referring to FIG. 1, according to an embodiment of the present disclosure, an electronic device 101 is included in a network environment 100. The electronic device 101 may include a bus 110, a processor 120, a memory 130, an input/output interface 150, a display 160, and a communication interface 170. In various embodiments of the present disclosure, the electronic device 101 may exclude at least one of the components or may add another component.

The bus 110 may include a circuit for connecting the components 110 to 170 with one another and transferring communications (e.g., control messages and/or data) between the components.

The processor 120 may include one or more of a CPU, an AP, or a communication processor (CP). The processor 120 may perform control on at least one of the other components of the electronic device 101, and/or perform an operation or data processing relating to communication.

The memory 130 may include a volatile and/or non-volatile memory. For example, the memory 130 may store commands or data related to at least one other component of the electronic device 101. According to an embodiment of the present disclosure, the memory 130 may store software and/or a program 140. The program 140 may include, e.g., a kernel 141, middleware 143, an application programming interface (API) 145, and/or an application program (or "application") 147. At least a portion of the kernel 141, middleware 143, or API 145 may be denoted an operating system (OS).

For example, the kernel 141 may control or manage system resources (e.g., the bus 110, processor 120, or a memory 130) used to perform operations or functions implemented in other programs (e.g., the middleware 143, API 145, or application program 147). The kernel 141 may provide an interface that allows the middleware 143, the API 145, or the application 147 to access the individual components of the electronic device 101 to control or manage the system resources.

The middleware 143 may function as a relay to allow the API 145 or the application 147 to communicate data with the kernel 141, for example.

Further, the middleware 143 may process one or more task requests received from the application program 147 in order of priority. For example, the middleware 143 may assign at least one of application programs 147 with priority of using system resources (e.g., the bus 110, processor 120, or memory 130) of at least one electronic device 101. For example, the middleware 143 may perform scheduling or load balancing on the one or more task requests by processing the one or more task requests according to the priority assigned to the at least one application program 147.

The API 145 is an interface allowing the application 147 to control functions provided from the kernel 141 or the middleware 143. For example, the API 133 may include at least one interface or function (e.g., a command) for filing control, window control, image processing or text control.

The input/output interface 150 may serve as an interface that may, e.g., transfer commands or data input from a user or other external devices to other component(s) of the electronic device 101. Further, the input/output interface 150 may output commands or data received from other component(s) of the electronic device 101 to the user or the other external device.

The display 160 may include, e.g., a liquid crystal display (LCD), a light emitting diode (LED) display, an organic LED (OLED) display, a microelectromechanical systems (MEMS) display, or an electronic paper display. The display 160 may display, e.g., various contents (e.g., text, images, videos, icons, or symbols) to the user. The display 160 may include a touchscreen and may receive, e.g., a touch, gesture, proximity or hovering input using an electronic pen or a body portion of the user.

The communication interface 170 may set up communication between the electronic device 101 and an external device (e.g., a first electronic device 102, a second electronic device 104, or a server 106). For example, the communication interface 170 may be connected with a network 162 through wireless communication or wired communication and may communicate with an external device (e.g., the second external electronic device 104 or server 106).

The wireless communication may be a cellular communication protocol and may use at least one of, e.g., long-term evolution (LTE), LTE-advanced (LTE-A), code division multiple access (CDMA), wideband CDMA (WCDMA), universal mobile telecommunications system (UMTS), wireless broadband (WiBro), or global system for mobile communications (GSM). Further, the wireless communication may include, e.g., a short-range communication 164. The short-range communication 164 may include at least one of, e.g., Wi-Fi, Bluetooth (BT), near-field communication (NFC), or GPS. The wired connection may include at least one of, e.g., universal serial bus (USB), high definition multimedia interface (HDMI), recommended standard (RS)-232, or plain old telephone service (POTS). The network 162 may include at least one of telecommunication networks, e.g., a computer network (e.g., local area network (LAN) or wide area network (WAN), Internet, or a telephone network.

The first and second external electronic devices 102 and 104 each may be a device of the same or a different type from the electronic device 101. According to an embodiment of the present disclosure, the server 106 may include a group of one or more servers. According to an embodiment of the present disclosure, all or some of operations executed on the electronic device 101 may be executed on another or multiple other electronic devices (e.g., the electronic devices 102 and 104 or server 106). According to an embodiment of the present disclosure, when the electronic device 101 should perform some function or service automatically or at a request, the electronic device 101, instead of executing the function or service on its own or additionally, may request another device (e.g., electronic devices 102 and 104 or server 106) to perform at least some functions associated therewith. The other electronic device (e.g., electronic devices 102 and 104 or server 106) may execute the requested functions or additional functions and transfer a result of the execution to the electronic device 101. The electronic device 101 may provide a requested function or service by processing the received result as it is or additionally. To that end, a cloud computing, a distributed computing, or a client-server computing technique may be used, for example.

Figure 2:
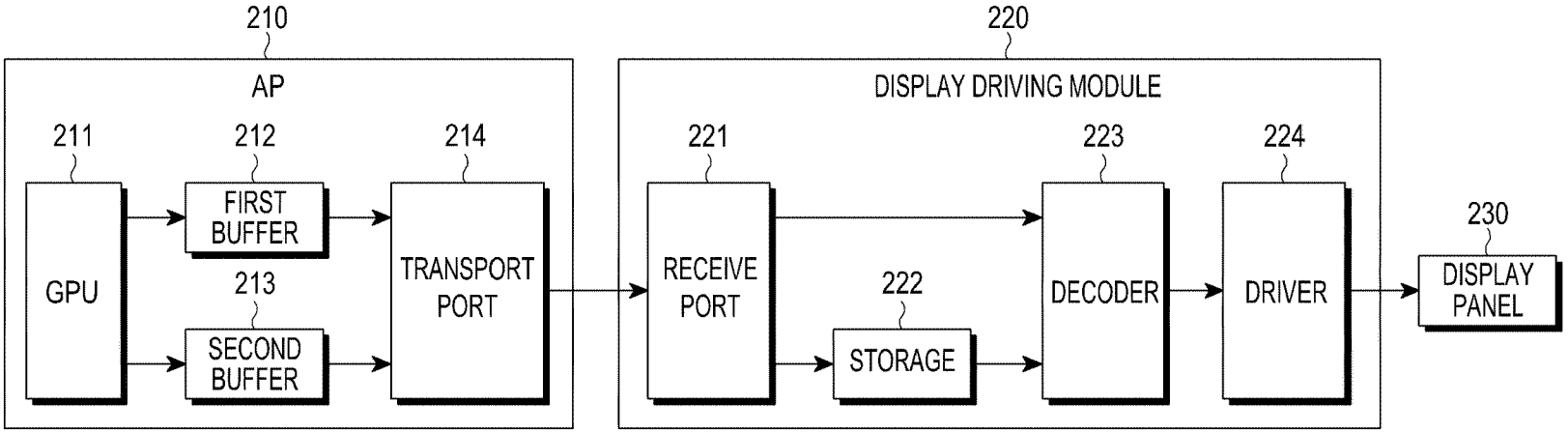
FIG. 2 is a block diagram illustrating an electronic device according to an embodiment of the present disclosure.

FIG. 2 is a block diagram illustrating an electronic device according to an embodiment of the present disclosure.

Referring to FIG. 2, the electronic device may include an AP 210, a display driving module 220 (e.g., a display driver integrated circuit (IC) (DDI)), and a display panel 230.

The AP 210 may control the overall operation related to display. The AP 210 may image-process content data to convert to display data on a per-frame basis, and may output the display data to the display driving module 220 through a high-speed serial interface. The high-speed serial interface may be any one of, e.g., a mobile industry processor interface (MIPI), a mobile display digital interface (MDDI), a compact display port (CDP), a mobile pixel link (MPL), and a current mode advanced differential signaling (CMADS).

The AP 210 may include a graphics processing unit (GPU) 211, a first buffer 212, a second buffer 213, and a transport port 214.

The GPU 211 may image-process content data on a per-frame basis to convert to display data and may selectively store the per-frame display data, i.e., frame data, in a first buffer 212 or a second buffer 213.

According to an embodiment of the present disclosure, the GPU 211, when the frame data is larger in volume than a reference volume, may compress the frame data and may selectively store the compressed frame data in the first buffer 212 or the second buffer 213. For example, the reference volume may be a bandwidth of the transport port 214. Accordingly, when the frame data is larger in volume than the bandwidth of the transport port 214, the GPU 211 may compress the frame data and selectively store the compressed frame data in the first buffer 212 or the second buffer 213. The volume of the frame data may be increased as the resolution of content increases.

The GPU 211, after storing frame data A in, e.g., the first buffer 212, may update the first buffer 212 with frame data B if frame data B is the same as frame data A. Or, if frame data B is different from frame data A, the GPU 211 may update the second buffer 213 with frame data B.

The frame data stored in the first buffer 212 or second buffer 213 may be transferred to the display driving module 220 through the transport port 214 supportive of a high-speed serial interface under the control of the GPU 211. The GPU 211 may transmit the frame data of the buffers 212 and 213 updated latest.

The display driving module 220 may output the input display data to the display panel 230 according to frame rates so that the display data may be displayed on the display panel 230.

The display driving module 220 may include a receive port 221, a storage 222, a decoder 223, and a driver 224.

The receive port 221 may support a high-speed serial interface and may receive frame data from the transport port 214. The receive port 221 may store the received frame data in the storage 222 or transfer the received frame data to a decoder 223 depending on settings.

The decoder 223 may transfer the frame data transferred from the receive port 221 to a driver 224 or may scan the frame data stored in the storage 222 and transfer to the driver 224. The decoder 223, if the received frame data or scanned frame data is not compressed, transfers the received data to the driver 224 as it is, and if the received data is compressed, decodes the received data and transfers it to the driver 224.

The driver 224 may output the transferred frame data to the display panel 230 depending on frame rates.

The display panel 230 may display the display data in units of frames under the control of the display driving module 220. The display panel 230 may be any one of an OLED, a LCD, a plasma display panel (PDP), an electrophoretic display panel, or an electrowetting display panel. Meanwhile, the display panel 230 is not limited thereto.

According to an embodiment of the present disclosure, the AP 210 may configure any one operation mode of a video mode or a video panel self refresh (PSR) mode in the electronic device and may control a display process as per the configured operation mode.

When the video mode is configured, the AP 210 may convert content data into frame data depending on frame rates in real-time and output to the display driving module 220. The AP 210 may control the display driving module 220 so that the display driving module 220 outputs frame data to the display panel 230 depending on frame rates in real-time. According to an embodiment of the present disclosure, under the video mode, the display driving module 220 may be operated so that the frame data may be directly transferred from the receive port 221 to the decoder 223, and according to an embodiment of the present disclosure, the display driving module 220 may be operated so that the frame data is updated in the storage 222, and the frame data updated in the storage 222 is scanned by the decoder 223. In the following embodiment, it is assumed that the display driving module 220 updates frame data in the storage 222.

According to an embodiment of the present disclosure, the AP 210, when a reference number or more of same frames continue, may configure the video PSR mode. For example, the reference number may be two. As the video PSR mode is configured, the transmission of frame data may be stopped or the display scan frequency may be adjusted.

The AP 210, after configuring the video PSR mode in the display driving module 220, may output frame data to the display driving module 220 and may turn off the communication port of the display driving module 220 and the AP 210. Accordingly, the transmission of frame data may be stopped. The display driving module 220 may store frame data in the storage 222, and as the video PSR mode is configured, although the transmission of frame data is stopped, the decoder 223 may scan the frame data stored in the storage 222 according to frame rates.

Additionally, the AP 210 may adjust scan display frequency when configuring the video PSR mode in the display driving module 220. In other words, a first scan display frequency in the video mode may differ from a second scan display frequency of the display driving module 220 in the video PSR mode, and the first scan display frequency may be lower than the second scan display frequency.

For example, in the video mode, the first scan display frequency may have a value corresponding to a frame rate, and in the video PSR mode, the second scan display frequency may be a frequency lower than the first scan display frequency. Accordingly, the number of times that the frame data stored in the storage 222 may be reduced in the video PSR mode, and thus, power consumption may be reduced.

According to an embodiment of the present disclosure, in the video PSR mode, both the stop of the transmission of frame data and the adjustment of display scan frequency may be performed or any one of the two functions may be performed.

Figure 3:
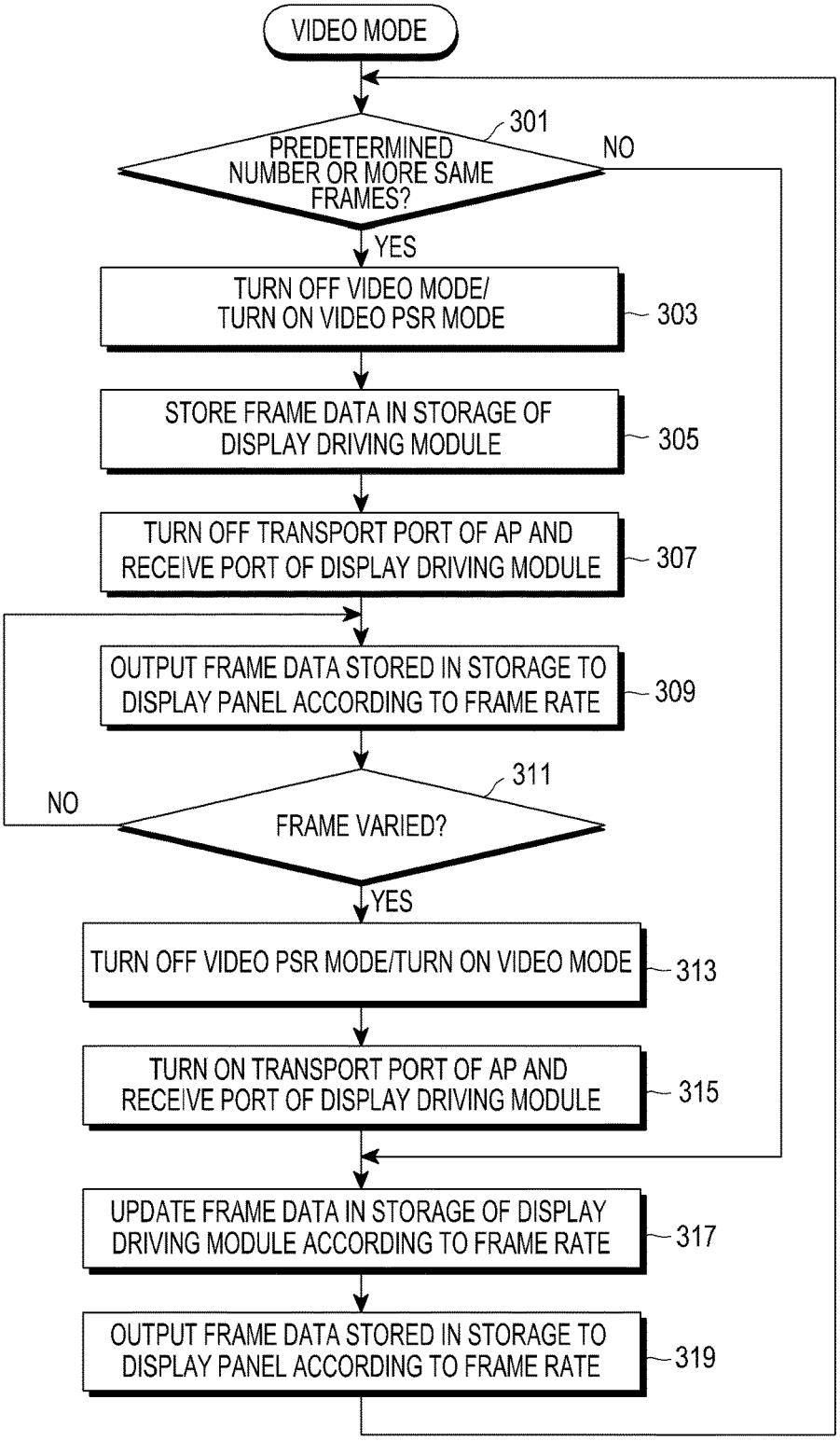
FIG. 3 is a view illustrating process for controlling a display according to an embodiment of the present disclosure.

Now described is a process for controlling display by an electronic device 101 as configured above, with reference to FIG. 3, according to an embodiment of the present disclosure.

FIG. 3 is a view illustrating a process for controlling a display according to an embodiment of the present disclosure. In the embodiment of FIG. 3, it is assumed that the process is initiated while a video mode is configured.

Referring to FIG. 3, while the video mode is configured, the AP 210 may convert content data into per-frame display data, i.e., frame data, according to frame rates. As in operation 301, the AP 210 may compare with a previous frame to identify whether it is the same, and, if the same, may identify whether a reference number of same frames or more continue. If so, the AP 210 proceeds with operation 303 to configure a video PSR mode.

Unless a reference number of same frames or more continue, the AP 210 may proceed with operation 317 while remaining in the video mode. In operation 317, the AP 210 may update the frame data in the storage 222 of the display driving module 220 according to frame rates.

In operation 319, the display driving module 220 may output the frame data stored in the storage 222 to the display panel 230 according to frame rates, and the display driving module 220 may return to operation 301. Accordingly, the frame data may be displayed on the display panel 230.

Meanwhile, if it is identified in operation 301 that a reference number of same frames or more continue, the AP 210 goes to operation 303 to turn off the video mode and turn on the video PSR mode. In operation 305, the AP 210 may store frame data in the storage 222 of the display driving module 220, and in operation 307, the AP 210 may stop communication of frame data. In other words, the AP 210 may turn off the transport port 214 and the receive port 221 in operation 307. Accordingly, the update of frame data in the storage 222 is stopped, but in operation 309, the display driving module 220 may scan the frame data stored in the storage 222 according to frame rates and output to the display panel 230.

The AP 210, in operation 307, may stop communication of frame data, but continue to convert content data into frame data. Accordingly, the AP 210 may compare the frame data being output in the video PSR mode with subsequent frame data in operation 311, and if the output frame data is the same as the subsequent frame data, may remain in the video PSR mode. If the video PSR mode remains, the frame data stored in the storage 222 continues to be scanned and may be output to the display panel 230.

Unless the output frame data is the same as the subsequent frame data, the AP 210 may turn off the video PSR mode and turn on the video mode in operation 313, and the AP 210 may turn on the transport port 214 and the receive port 221 in operation 315. In operation 317, the AP 210 may update the frame data in the storage 222 of the display driving module 220 according to frame rates.

In operation 319, the display driving module 220 may output the frame data stored in the storage 222 to the display panel 230 according to frame rates, and may proceed with operation 301 to repeat operations 301 to 319.

Additionally, upon configuring the video PSR mode in operations 303 to 307, the display scan frequency of the display driving module 220 may be adjusted. For example, when the video PSR mode is turned on, a display scan frequency may be configured in the display driving module 220 so as to respond to an ultra high-definition (HD) resolution such as a second Full HD standard corresponding to the video PSR mode. The second display scan frequency corresponding to the video PSR mode may be lower than the first display scan frequency corresponding to the video mode. Accordingly, the display driving module 220, in operation 309, may scan the frame data stored in the storage 222 according to the second scan frequency and may output to the display panel 230.

Further, upon configuring the video mode in operations 313 to 317, the display scan frequency of the display driving module 220 may be adjusted. For example, upon turning on the video mode, the first display scan frequency corresponding to the video mode may be configured in the display driving module 220. The first display scan frequency may correspond to a frame rate.

Figure 4:
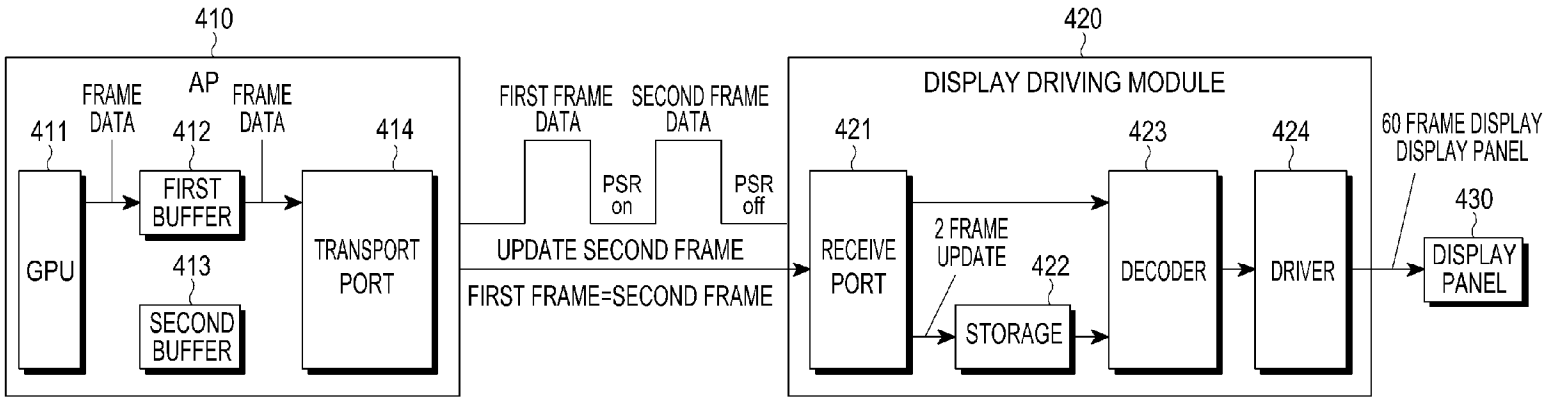
FIG. 4 is a view illustrating a process of setting a video panel self refresh (PSR) mode according to an embodiment of the present disclosure.
Figure 5:
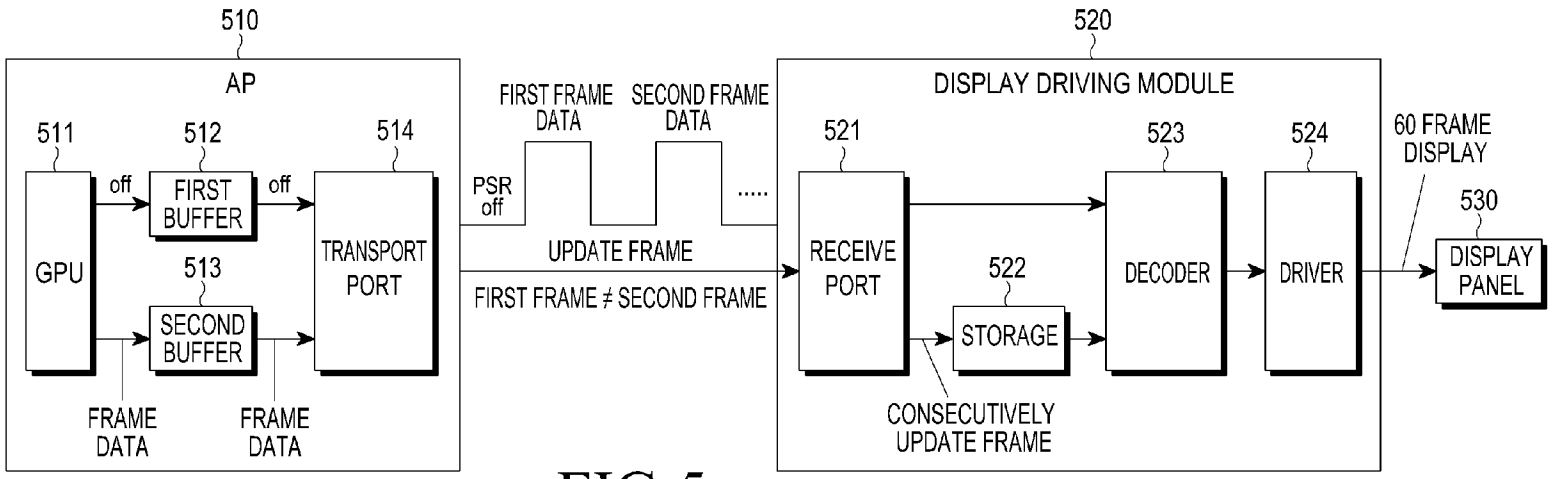
FIG. 5 is a view illustrating a process of terminating a video PSR mode according to an embodiment of the present disclosure.

Next described is a process for configuring and terminating a video PSR mode with reference to FIGS. 4 and 5 according to exemplary embodiments of the disclosure.

FIG. 4 is a view illustrating a process for setting a video PSR mode according to an embodiment of the present disclosure.

Referring to FIG. 4, the AP 410 may continue to identify whether the video PSR mode is configured while operating in the video mode. Whether the video PSR mode is configured may be determined depending on whether the number of same frames is not less than a reference number as described above. In the embodiment of FIG. 4, it may be assumed that first frame data is the same as second frame data.

In the video mode, the GPU 411 of the AP 410 may generate the first frame data and store in the first buffer 412 as opposed to the second buffer 413. The first frame data stored in the first buffer 412 may be output to the display driving module 420 through the transport port 414.

The receive port 421 of the display driving module 420 may update the first frame data in the storage 422, and the decoder 423 may scan the first frame data stored in the storage 422 and transfer to the driver 424. In this case, if the first frame data is compressed, the decoder 423 may decode the compressed frame data and transfer the decoded data to the driver 424. The driver 424 may output first frame data to the display panel 430.

The GPU 411 may store the first frame data in the first buffer 412 and generate subsequent second frame data depending on a frame rate. The GPU 411 may compare the second frame data with the first frame data stored in the first buffer 412, and if the comparison shows that the first frame data and the second frame data are the same, the GPU 411 may determine to configure the video PSR mode. Since the first frame data and the second frame data are the same as each other, the AP 410 may output the first frame data to the display driving module 420 and then may transfer a request for turning on the video PSR mode to the display driving module 420. Since the second frame data is the same as the first frame data, it may be updated in the first buffer 412.

When receiving the request for turning on the video PSR mode, the display driving module 420 may set the video PSR mode.

After the request for turning on the video PSR mode is output to the display driving module 420, the AP 410 may output the second frame data stored in the first buffer 412 to the display driving module 420 through the transport port 414.

The second frame data transferred through the transport port 421 may be updated in the storage 422 of the display driving module 420, and the decoder 423 may scan the second frame data stored in the storage 422 and transfer to the driver 424. In this case, if the second frame data is compressed, the decoder 423 may decode the compressed frame data and transfer the decoded data to the driver 424. The driver 424 may output the second frame data to the display panel 430.

The AP 410 may output the second frame data to the display driving module 420 and then turn off the transport port 414 and output a request for turning off the transport port 421 to the display driving module 420.

In response to the turn-off request, the display driving module 420 may turn off the receive port 421. The decoder 423 may scan the second frame data updated in the storage 422 while the video PSR mode is maintained according to a frame rate and may transfer to the driver 424.

The GPU 411, after storing the second frame data in the first buffer 412, may generate third frame data according to a frame rate. The GPU 411 may compare the third frame data with the second frame data stored in the first buffer 412, and if the comparison shows that the third frame data and the second frame data are the same, the video PSR mode may be maintained.

As such, the number of times that frame data is transferred to the display driving module 420 during the video PSR mode may be reduced, and accordingly, power consumption may be decreased. The clock of the high-speed serial interface is operated at the same clock without being turned off even during the video PSR mode, preventing problems with display that may occur due to synchronization upon switching to the video mode.

Now described is a process for terminating a video PSR mode with reference to FIG. 5 according to an embodiment of the present disclosure.

FIG. 5 is a view illustrating a process of terminating a video PSR mode according to an embodiment of the present disclosure.

Referring to FIG. 5, the AP 510 may continue to generate frame data according to frame rates while operating in a video PSR mode, compare frame data stored in a first buffer 512 (or second buffer 513) with the generated frame data, and determine whether to terminate the video PSR mode depending on a result of the comparison.

In the embodiment of FIG. 5, it may be assumed that the first frame data and second frame data are not identical to each other and that the buffer storing the frame data in the video PSR mode is the first buffer 512.

In the video PSR mode, the GPU 511 of the AP 510 may generate first frame data according to a frame rate and compare the first frame data with frame data stored in the first buffer 512. When a result of the comparison shows that the first frame data is not identical to the frame data stored in the first buffer 512, the AP 510 may determine to terminate the video PSR mode. Accordingly, the AP 510 may turn on the transport port 514 and may transfer a request for turning off the video PSR mode to the display driving module 520. The first frame data may be updated in the second buffer 513.

When the request for turning off the video PSR mode is transferred to the display driving module 520, the display driving module 520 may terminate the video PSR mode, turn on the receive port 521, and set a video mode.

The AP 510, after outputting the request for turning off the video PSR mode, may output the first frame data stored in the second buffer 513 to the display driving module 520 through the transport port 514.

The receive port 521 of the display driving module 520 may update the first frame data in the storage 522, and the decoder 523 may scan the first frame data stored in the storage 522 and transfer to the driver 524. In this case, if the first frame data is compressed, the decoder 523 may decode the compressed frame data and transfer the decoded data to the driver 524. The driver 524 may output first frame data to the display panel 530.

The GPU 511, after storing the first frame data in the first buffer 512, may generate subsequent second frame data according to a frame rate. The GPU 511 may compare the second frame data with the first frame data stored in the first buffer 512, and if a result of the comparison shows that the second frame data is not identical to the first frame data, may maintain the video mode. The second frame data may be updated in the first buffer 512. The AP 510 may output the second frame data stored in the first buffer 512 to the display driving module 520 through the transport port 514.

The second frame data transferred through the transport port 521 may be updated in the storage 522 of the display driving module 520, and the decoder 523 may scan the second frame data stored in the storage 522 and transfer to the driver 524. In this case, if the second frame data is compressed, the decoder 523 may decode the compressed frame data and transfer the decoded data to the driver 524. The driver 524 may output the second frame data to the display panel 530.

In the example described above in connection with FIGS. 4 and 5, the display scan frequency of the display driving module 420 and 520 remain unchanged. However, alternatively, the display scan frequency corresponding to an operation mode may be set. For example, in the embodiment of FIG. 4, the AP 410, after transferring the request for turning on the video PSR mode to the display driving module 420, may transmit the second frame data together with a second display scan frequency corresponding to the video PSR mode. Accordingly, the display driving module 420 may scan the frame data stored in the storage 422 according to the second display scan frequency and may output to the display panel 430. In the embodiment of FIG. 5, when the AP 510 transfers a request for turning on the video mode to the display driving module 520, the display driving module 520 may set a first display scan frequency corresponding to the video mode.

Figure 6:
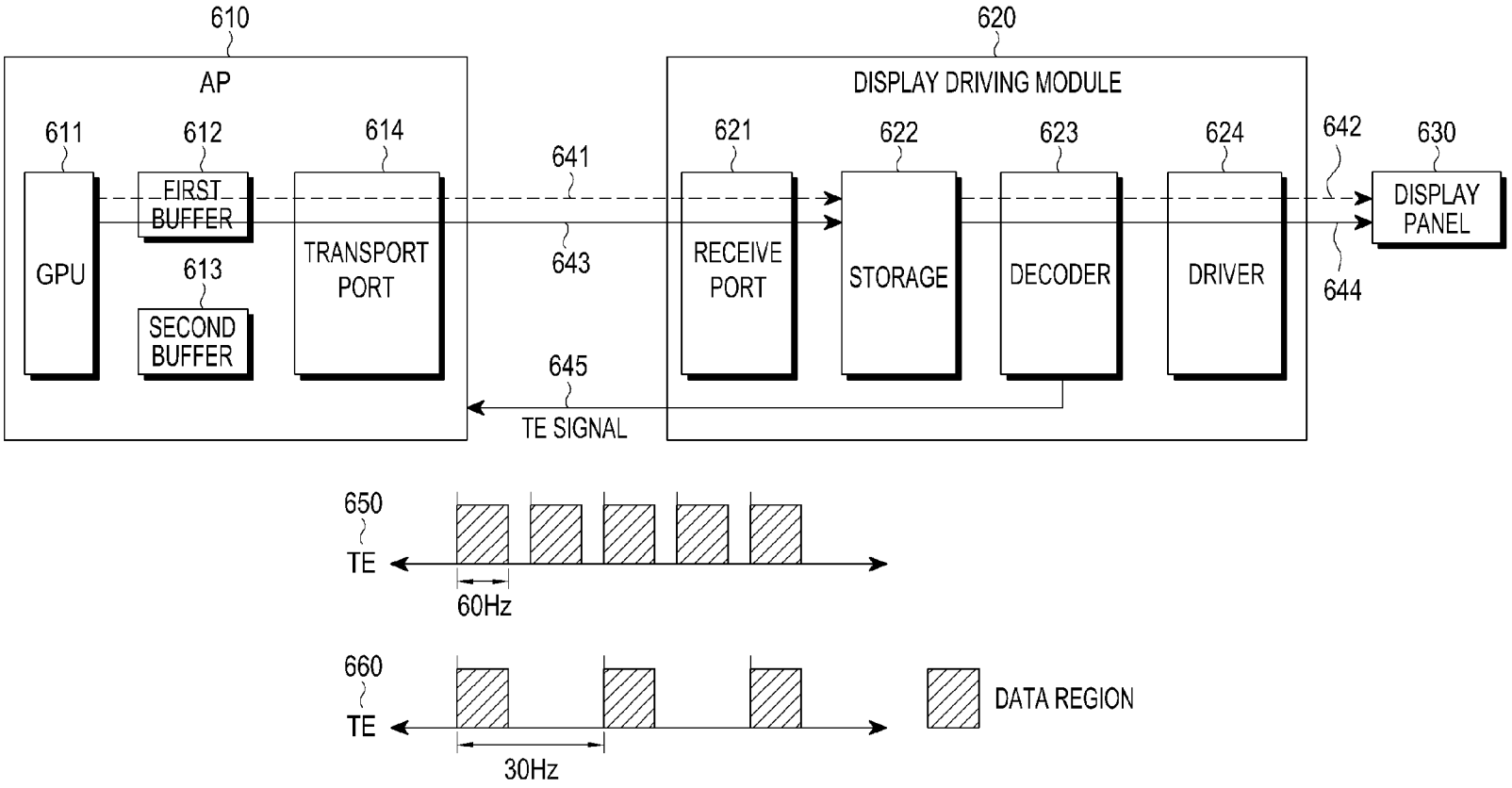
FIG. 6 is a view illustrating a process of adjusting scan display frequency according to an embodiment of the present disclosure.
Figure 7:
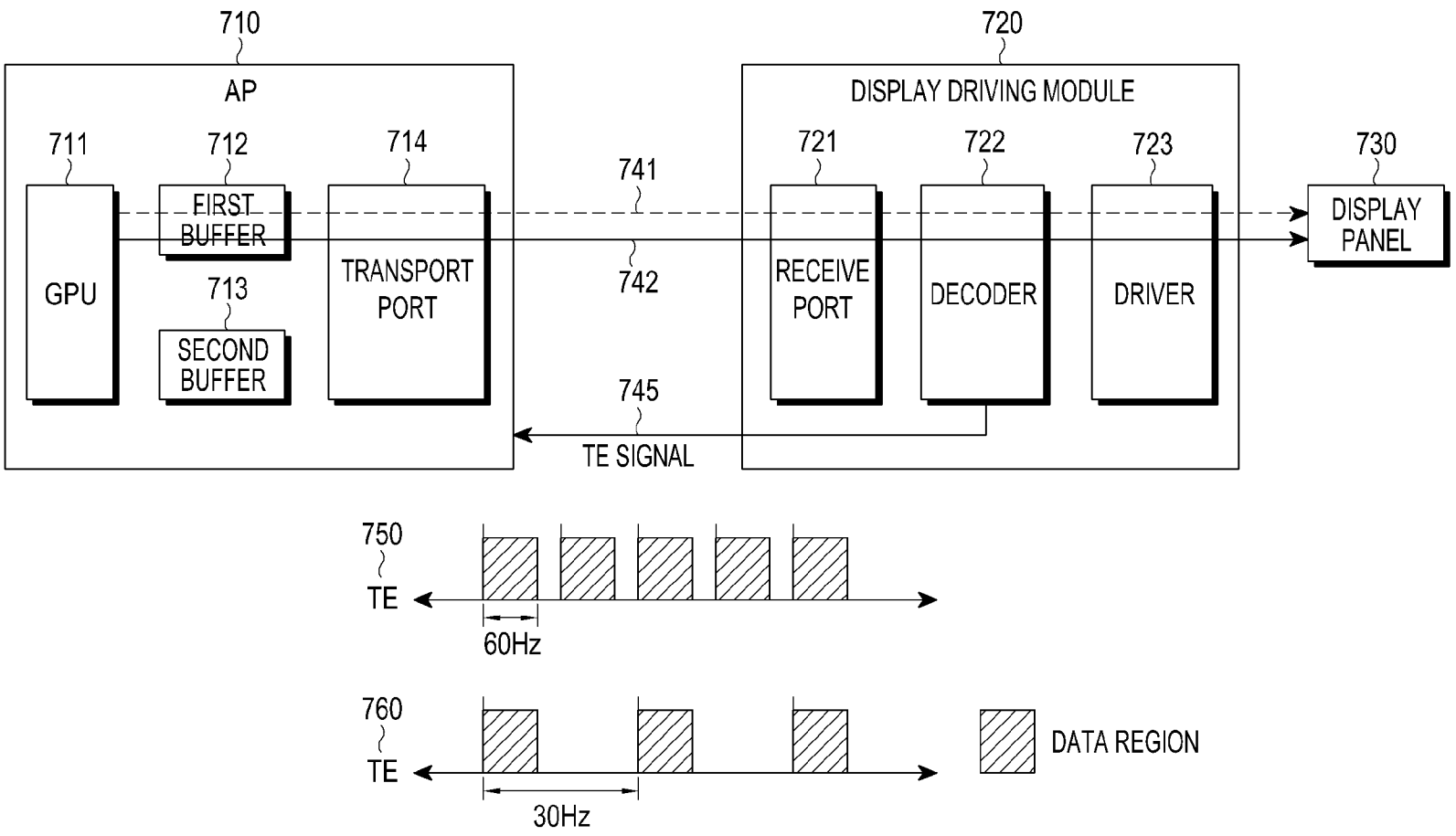
FIG. 7 is a view illustrating a process of adjusting scan display frequency according to an embodiment of the present disclosure.

FIGS. 6 and 7 illustrate an operation as per adjustment of display scan frequency according to an embodiment of the present disclosure.

FIG. 6 is a view illustrating a process of adjusting scan display frequency according to an embodiment of the present disclosure.

Referring to FIG. 6, operations 641 and 642 describe an example in which when setting the video PSR mode, display scan frequency is not adjusted. In this case, the display scan frequency may correspond to a frame rate. For example, it may be assumed that the display scan frequency is 60 Hz, and the frame rate is 60 fps. As shown in FIG. 6, operations 643 and 644 describe an example in which when setting the video PSR mode, display scan frequency is adjusted. In this case, it may be assumed that the display scan frequency set is 30 Hz, and the frame rate is 60 fps.

As shown in FIG. 6, the GPU 611 of the AP 610, when a predetermined number of same frame data or more continue in operation 641, determines to set the video PSR mode and may update generated frame data in the first buffer 612 as opposed to the second buffer 613. The AP 610 may send a request for setting the video PSR mode to the display driving module 620 and may transfer the frame data updated in the first buffer 612 to the display driving module 620 through the transport port 614. Accordingly, the display driving module 620 may set the video PSR mode and store the frame data received through the receive port 621 in the storage 622. Thereafter, the AP 610 may turn off the transport port 614 and output a request for turning off the receive port 621 to the display driving module 620. In response to the turn-off request, the display driving module 620 may turn off the receive port 621.

In operation 642, the decoder 623 of the display driving module 620 may transfer the frame data updated in the storage 622 to the driver 624 according to a display scan frequency of, e.g., 60 Hz, depending on a frame rate while the video PSR mode is maintained. The driver 624 may output frame data to the display panel 630 according to a frame rate.

According to an embodiment of the present disclosure, the GPU 611 of the AP 610, when a predetermined number of same frame data or more continue in operation 643, determines to set the video PSR mode and may update generated frame data in the first buffer 612. The AP 610 may send a request for setting the video PSR mode to the display driving module 620 and may transfer the display scan frequency and the frame data updated in the first buffer 612 to the display driving module 620 through the transport port 614. Accordingly, the display driving module 620 may set the video PSR mode and store the frame data received through the receive port 621 in the storage 622. The display driving module 620 may set the display scan frequency to the received display scan frequency. Thereafter, the AP 610 may turn off the transport port 614 and output a request for turning off the receive port 621 to the display driving module 620. In response to the turn-off request, the display driving module 620 may turn off the receive port 621.

In operation 644, the decoder 623 of the display driving module 620 may scan the frame data updated in the storage 622 according to the display scan frequency, e.g., 30 Hz, received from the AP 610 while the video PSR mode is maintained and may transfer to the driver 624. The decoder 623 of the display driving module 620 may transfer memory sync signals (e.g., tearing effect (TE) signals) 645 to the AP 610 whenever frame data is output to the driver 624.

As shown in FIG. 6, the first graph 650 illustrates a frame data output state according to operations 641 and 642, and the second graph 660 illustrates a frame data output state according to operations 643 and 644. As such, as the period frame data is scanned is reduced, power consumption may be decreased.

FIG. 7 is a view illustrating a process of adjusting scan display frequency according to an embodiment of the present disclosure.

Referring to FIG. 7, a display driving module 720 is provided that does not include a storage. In other words, FIG. 7 illustrates an operation as per a video PSR mode setting when the electronic device includes a display driving module 720 without a storage. When a display driving module like the display driving module 720 does not include a separate storage (e.g., a random access memory (RAM)), the frame data generated by the AP 710 might not be stored in the display driving module 720. Accordingly, even when the video PSR mode is set, the transport port 714 or receive port 721 cannot be turned off. However, according to an embodiment of the present disclosure, display scan frequency may be adjusted to reduce power consumption.

It may be assumed in connection with FIG. 7 that the display scan frequency corresponding to the video mode is 60 Hz corresponding to a frame rate, 60 fps, and that the display scan frequency corresponding to the video PSR mode is 30 Hz.

Referring to FIG. 7, the GPU 711 of the AP 710, when a predetermined number of same frame data or more continue in operation 741, determines to set the video PSR mode and may update generated frame data in the first buffer 712, as opposed to the second buffer 713. The AP 710 may send a request for setting the video PSR mode to the display driving module 720 and may transfer the frame data updated in the first buffer 712 to the display driving module 720 through the transport port 714. Further, the AP 710 may set a display scan frequency corresponding to the video PSR mode. For example, in the video mode, the display scan frequency may be set to 60 Hz, and in the video PSR mode, the display scan frequency may be set to 30 Hz.

The display driving module 720 may set the video PSR mode in response to a request from the AP 710, and the frame data received through the receive port 721 may be transferred to the decoder 722. The decoder 722 of the display driving module 720 may transfer memory sync signals (e.g., TE signals) 745 to the AP 710 whenever frame data is output to the driver 723.

In operation 742, the AP 710, after requesting to set the video PSR mode, may generate next frame data according to a frame rate, compare it with the frame data stored in the first buffer 712, and determine whether to maintain the video PSR mode. When a result of the comparison shows that the generated frame data is the same as the frame data stored in the first buffer 712, the video PSR mode may be maintained, and the GPU 711 may update the first buffer 712. The AP 710, after requesting to set the video PSR mode, may transfer the frame data stored in the first buffer 712 to the display driving module 720 through the transport port 714 according to a display scan frequency corresponding to the video PSR mode by referencing the sync signal (e.g., a TE signal) received from the display driving module 720. For example, according to a display scan frequency of 30 Hz, the frame data stored in the first buffer 712 may be allowed to be transferred to the display driving module 720.

As shown in FIG. 7, the third graph 750 illustrates a frame data output state when the display scan frequency is 60 Hz, and the fourth graph 760 illustrates a frame data output state when the display scan frequency is 30 Hz. As such, as the period frame data is output is reduced, power consumption may be decreased. Further, the AP 710 may transmit frame data to the display driving module 720 according to the display scan frequency corresponding to the video PSR mode by referencing the TE signal transferred from the display driving module 720, and the AP 710 may thus adjust the period during which the frame data is output while not varying the pixel clock of the display panel 730.

Figure 8:
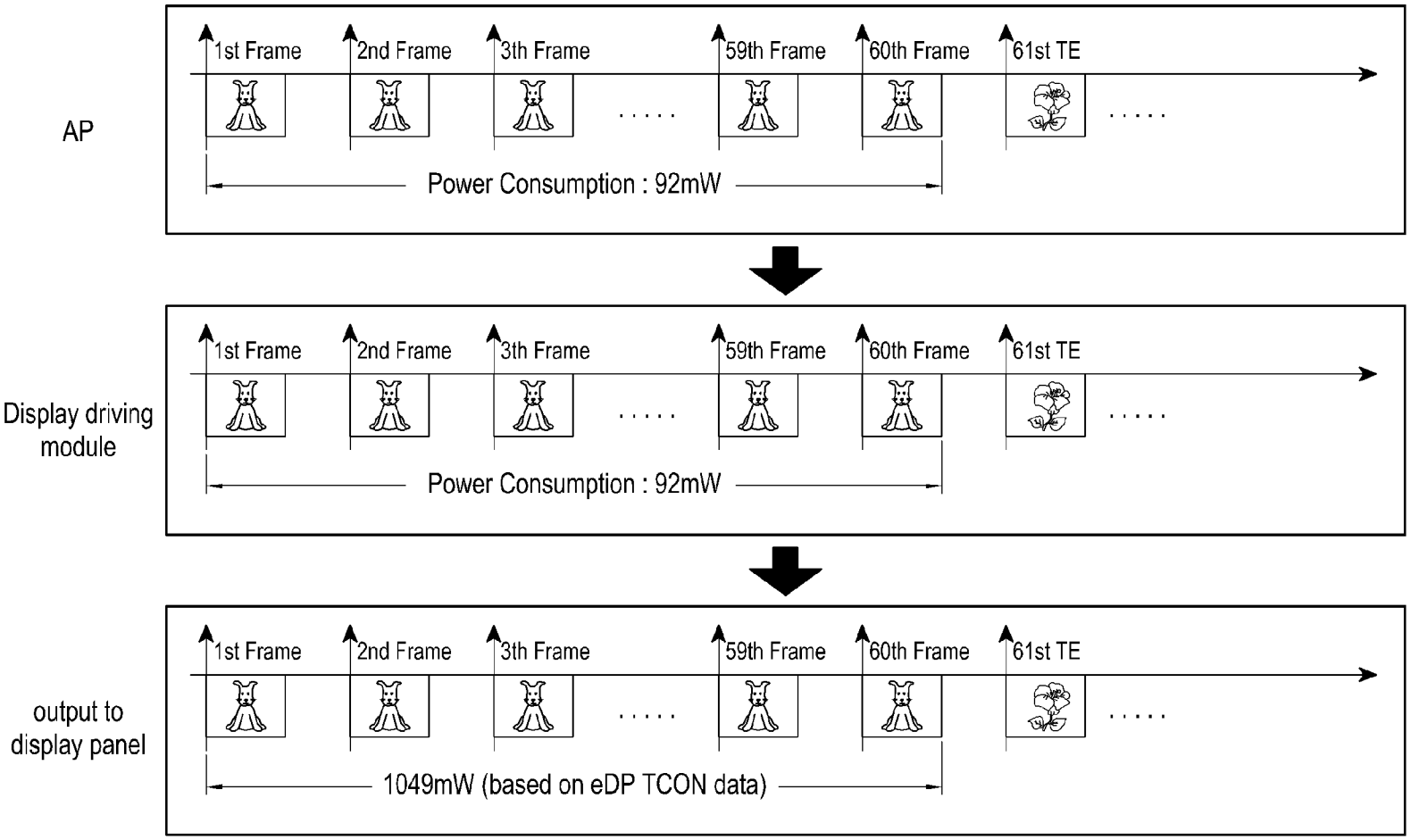
FIG. 8 is a view illustrating power consumption as per display control according to an embodiment of the present disclosure.

FIG. 8 is a view illustrating power consumption as per display control according to an embodiment of the present disclosure. In the embodiment of FIG. 8, it may be assumed that the frame rate is 60 fps, the display scan frequency corresponding to the video mode is 60 Hz, and the display scan frequency corresponding to the video PSR mode is 30 Hz.

Referring to FIG. 8, the first chart shown at the upper part of FIG. 8 shows frame data generated by the GPU of the AP according to a frame rate. The second chart shown in the middle of FIG. 8 shows frame data transferred from the AP to the display driving module in the video PSR mode. The third chart shown at the lower part of FIG. 8 shows frame data output from the display driving module to the display panel according to the display scan frequency in the video PSR mode.

Referring to the first chart, the GPU may generate 60 frame data. Referring to the second chart, however, two frame data are transferred from the AP to the display driving module in the video PSR mode. In other words, transport power for 58 frame data may be saved.

Further, referring to the third chart, the number of times in which scanning is performed for frame data in the video PSR mode is 30 for one second, and thus, power consumption may be saved.

Hereinafter, an example of an implementation of an electronic device is described with reference to FIGS. 9 and 10.

Figure 9:
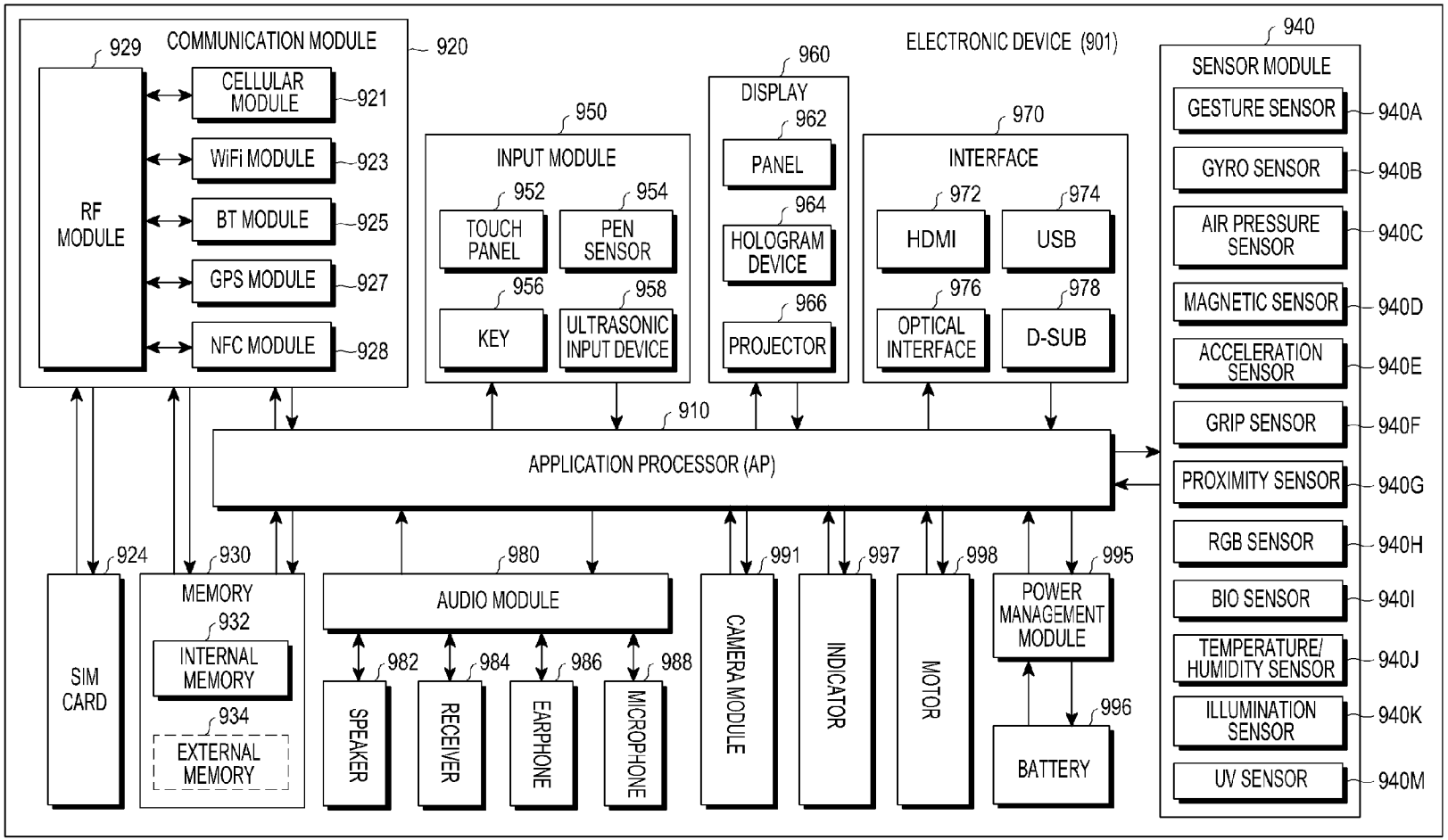
FIG. 9 is a block diagram illustrating a structure of an electronic device according to an embodiment of the present disclosure.

FIG. 9 is a block diagram illustrating a structure of an electronic device according to an embodiment of the present disclosure.

Referring to FIG. 9, the electronic device 901 may include the whole or part of the configuration of, e.g., the electronic device 101 shown in FIG. 1. The electronic device 901 may include one or more APs 910, a communication module 920, a subscriber identification module (SIM) card 924, a memory 930, a sensor module 940, an input device 950, a display 960, an interface 970, an audio module 980, a camera module 991, a power management module 995, a battery 996, an indicator 997, and a motor 998.

The AP 910 may control multiple hardware and software components connected to the AP 910 by running, e.g., an operating system or application programs, and the AP 2010 may process and compute various data. The AP 910 may be implemented in, e.g., a system on chip (SoC). According to an embodiment of the present disclosure, the AP 910 may further include a GPU and/or an image signal processor (ISP). The AP 910 may include at least some (e.g., the cellular module 921) of the components shown in FIG. 9. The AP 910 may load a command or data received from at least one of other components (e.g., a non-volatile memory) on a volatile memory, process the command or data, and store various data in the non-volatile memory.

The communication module 920 may have the same or similar configuration to the communication interface 170 of FIG. 1. The communication module 920 may include, e.g., a cellular module 921, a Wi-Fi module 923, a BT module 925, a GPS module 927, an NFC module 928, and a radio frequency (RF) module 929.

The cellular module 921 may provide voice call, video call, text, or Internet services through a communication network (e.g., an LTE, LTE-A, CDMA, WCDMA, UMTS, WiBro, or GSM network). The cellular module 921 may perform identification or authentication on the electronic device 901 in the communication network using a SIM (e.g., the SIM card 924). According to an embodiment of the present disclosure, the cellular module 921 may perform at least some of the functions providable by the AP 910. According to an embodiment of the present disclosure, the cellular module 921 may include a CP.

The Wi-Fi module 923, the BT module 925, the GPS module 927, or the NFC module 928 may include a process for, e.g., processing data communicated through the module. According to an embodiment of the present disclosure, at least some (e.g., two or more) of the cellular module 921, the Wi-Fi module 923, the BT module 925, the GPS module 927, and the NFC module 928 may be included in a single IC or an IC package.

The RF module 929 may communicate data, e.g., communication signals (e.g., RF signals). The RF module 929 may include, e.g., a transceiver, a power amp module (PAM), a frequency filter, a low noise amplifier (LNA), or an antenna. According to an embodiment of the present disclosure, at least one of the cellular module 921, the Wi-Fi module 923, the BT module 925, the GPS module 927, or the NFC module 928 may communicate RF signals through a separate RF module.

The SIM card 924 may include, e.g., a card including a SIM and/or an embedded SIM, and may contain unique identification information (e.g., an IC card identifier (ICCID) or subscriber information (e.g., an international mobile subscriber identity (IMSI)).

The memory 930 (e.g., the memory 130) may include, e.g., an internal memory 932 or an external memory 934. The internal memory 922 may include at least one of, e.g., a volatile memory (e.g., a dynamic RAM (DRAM), a static RAM (SRAM), a synchronous DRAM (SDRAM), etc.) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash, or a NOR flash), a hard drive, or solid state drive (SSD).

The external memory 934 may include a flash drive, e.g., a compact flash (CF) memory, a secure digital (SD) memory, a micro-SD memory, a mini-SD memory, an extreme digital (xD) memory, or a memory Stick™. The external memory 934 may be functionally and/or physically connected with the electronic device 901 via various interfaces.

For example, the sensor module 940 may measure a physical quantity or detect an operational state of the electronic device 901, and the sensor module 940 may convert the measured or detected information into an electrical signal. The sensor module 940 may include, e.g., a gesture sensor 940A, a gyro sensor 940B, an atmospheric pressure sensor 940C, a magnetic sensor 940D, an acceleration sensor 940E, a grip sensor 940F, a proximity sensor 940G, a color sensor 940H such as a red, green, blue (RGB) sensor, a bio sensor 940I, a temperature/humidity sensor 940J, an illumination sensor 940K, or an ultra violet (UV) sensor 940M. Additionally or alternatively, the sensing module 940 may include, e.g., an e-nose sensor, an electromyography (EMG) sensor, an electroencephalogram (EEG) sensor, an electrocardiogram (ECG) sensor, an infrared (IR) sensor, an iris sensor, or a finger print sensor. The sensor module 940 may further include a control circuit for controlling at least one or more of the sensors included in the sensing module. According to an embodiment of the present disclosure, the electronic device 901 may further include a processor configured to control the sensor module 940 as part of an AP 910 or separately from the AP 910, and the electronic device 901 may control the sensor module 940 while the AP is in a sleep mode.

The input unit 950 may include, e.g., a touch panel 952, a (digital) pen sensor 954, a key 956, or an ultrasonic input device 958. The touch panel 952 may use at least one of capacitive, resistive, infrared, or ultrasonic methods. The touch panel 952 may further include a control circuit. The touch panel 952 may further include a tactile layer and may provide a user with a tactile reaction.

The (digital) pen sensor 954 may include, e.g., a part of a touch panel or a separate sheet for recognition. The key 956 may include e.g., a physical button, optical key or key pad. The ultrasonic input device 958 may use an input tool that generates an ultrasonic signal and enable the electronic device 901 to identify data by sensing the ultrasonic signal to a microphone 988.

The display 960 (e.g., the display 160) may include a panel 962, a hologram device 964, or a projector 966. The panel 962 may have the same or similar configuration to the display 160 of FIG. 1. The panel 962 may be implemented to be flexible, transparent, or wearable. The panel 962 may also be incorporated with the touch panel 952 in a module. The hologram device 964 may make three dimensional (3D) images (holograms) in the air by using light interference. The projector 966 may display an image by projecting light onto a screen. The screen may be, for example, located inside or outside of the electronic device 901. In accordance with an embodiment of the present disclosure, the display 960 may further include a control circuit to control the panel 962, the hologram device 964, or the projector 966.

The interface 970 may include e.g., an HDMI 972, a USB 974, an optical interface 976, or a D-subminiature (D-sub) 978. The interface 970 may be included in e.g., the communication interface 170 shown in FIG. 1. Additionally or alternatively, the interface 970 may include a mobile high-definition link (MHL) interface, an SD card/multimedia card (MMC) interface, or IrDA standard interface.

The audio module 980 may convert a sound into an electric signal or vice versa, for example. At least a part of the audio module 980 may be included in e.g., the input/output interface 150 as shown in FIG. 1. The audio module 980 may process sound information input or output through e.g., a speaker 982, a receiver 984, an earphone 986, or the microphone 988.

The camera module 991 may be a device for capturing still images and videos, and may include, according to an embodiment of the present disclosure, one or more image sensors (e.g., front and back sensors), a lens, an ISP, or a flash such as an LED or xenon lamp.

The power manager module 995 may manage power of the electronic device 901, for example. Although not shown, according to an embodiment of the present disclosure, a power management IC (PMIC), a charger IC, or a battery or fuel gauge is included in the power manager module 995. The PMIC may have a wired and/or wireless recharging scheme. The wireless charging scheme may include e.g., a magnetic resonance scheme, a magnetic induction scheme, or an electromagnetic wave based scheme, and an additional circuit, such as a coil loop, a resonance circuit, a rectifier, or the like may be added for wireless charging. The battery gauge may measure an amount of remaining power of the battery 996, a voltage, a current, or a temperature while the battery 996 is being charged. The battery 996 may include, e.g., a rechargeable battery or a solar battery.

The indicator 998 may indicate a particular state of the electronic device 901 or a part of the electronic device (e.g., the AP 910), including e.g., a booting state, a message state, or recharging state. The motor 998 may convert an electric signal to a mechanical vibration and may generate a vibrational or haptic effect. Although not shown, a processing unit for supporting mobile TV, such as a GPU may be included in the electronic device 901. The processing unit for supporting mobile TV may process media data conforming to a standard for digital multimedia broadcasting (DMB), digital video broadcasting (DVB), or media flow.

Each of the aforementioned components of the electronic device may include one or more parts, and a name of the part may vary with a type of the electronic device. The electronic device in accordance with various embodiments of the present disclosure may include at least one of the aforementioned components, omit some of them, or include other additional component(s). Some of the components may be combined into an entity, but the entity may perform the same functions as the components may do.

Figure 10:
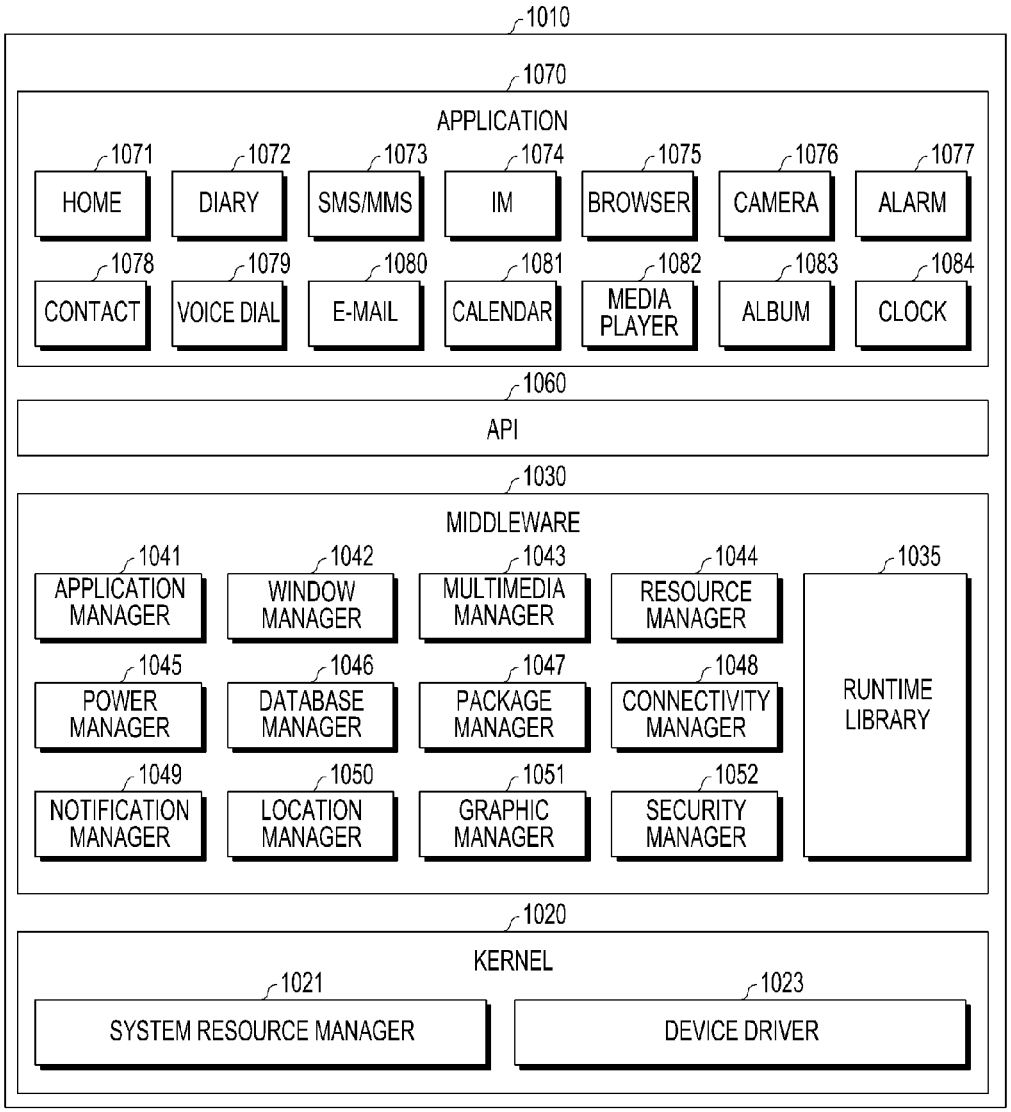
FIG. 10 is a block diagram illustrating a program module according to an embodiment of the present disclosure.

FIG. 10 is a block diagram illustrating a program module according to an embodiment of the present disclosure.

Referring to FIG. 10, according to an embodiment of the present disclosure, the program module 1010 (e.g., the program 140) may include an (OS controlling resources related to the electronic device (e.g., the electronic device 101) and/or various applications (e.g., the applications 147) driven on the operating system. The operating system may include, e.g., Android, iOS, Windows, Symbian, Tizen, or Bada.

The program 1010 may include, e.g., a kernel 1020, middleware 1030, an API 1060, and/or an application 1070. At least a part of the program module 1010 may be preloaded on the electronic device or may be downloaded from a server (e.g., the server 106).

The kernel 1020 (e.g., the kernel of FIG. 1) may include, e.g., a system resource manager 1021 or a device driver 1023. The system resource manager 1021 may perform control, allocation, or recovery of system resources. According to an embodiment of the present disclosure, the system resource manager 1021 may include a process managing unit, a memory managing unit, or a file system managing unit. The device driver 1023 may include, e.g., a display driver, a camera driver, a BT driver, a shared memory driver, a USB driver, a keypad driver, a Wi-Fi driver, an audio driver, or an inter-process communication (IPC) driver.

The middleware 1030 may provide various functions to the application 1070 through the API 1060 so that the application 1070 may efficiently use limited system resources in the electronic device or provide functions jointly required by applications 1070. According to an embodiment of the present disclosure, the middleware 1030 (e.g., middleware 143) may include at least one of a runtime library 1035, an application manager 1041, a window manager 1042, a multimedia manager 1043, a resource manager 1044, a power manager 1045, a database manager 1046, a package manager 1047, a connectivity manager 1048, a notification manager 1049, a location manager 1050, a graphic manager 1051, or a security manager 1052.

The runtime library 1035 may include a library module used by a compiler in order to add a new function through a programming language while, e.g., the application 1070 is being executed. The runtime library 1035 may perform input/output management, memory management, or operation on arithmetic functions.

The application manager 1041 may manage the life cycle of at least one application of, e.g., the applications 1070. The window manager 1042 may manage GUI resources used on the screen. The multimedia manager 1043 may grasp formats necessary to play various media files and use a codec appropriate for a format to perform encoding or decoding on media files. The resource manager 1044 may manage resources, such as source code of at least one of the applications 1070, memory or storage space.

The power manager 1045 may operate together with, e.g., a basic input/output system (BIOS) to manage battery or power and provide power information necessary for operating the electronic device. The database manager 1046 may generate, search, or vary a database to be used in at least one of the applications 1070. The package manager 1047 may manage installation or update of an application that is distributed in the form of a package file.

The connectivity manager 1048 may manage wireless connectivity, such as, e.g., Wi-Fi or BT. The notification manager 1049 may display or notify an event, such as a coming message, appointment, or proximity notification, of the user without interfering with the user. The location manager 1050 may manage locational information on the electronic device. The graphic manager 1051 may manage graphic effects to be offered to the user and their related user interface. The security manager 1052 may provide various security functions necessary for system security or user authentication. According to an embodiment of the present disclosure, when the electronic device (e.g., the electronic device 101) has telephony capability, the middleware 1030 may further include a telephony manager for managing voice call or video call functions of the electronic device.

The middleware 1030 may include a middleware module forming a combination of various functions of the above-described components. The middleware 1030 may provide a specified module per type of the operating system in order to provide a differentiated function. Further, the middleware 1030 may dynamically omit some existing components or add new components.

The API 1060 (e.g., the API 145) may be a set of, e.g., API programming functions and may have different configurations depending on operating systems. For example, in the case of Android or iOS, one API set may be provided per platform, and in the case of Tizen, two or more API sets may be offered per platform.

The application 1070 (e.g., the applications 147) may include one or more applications that may provide functions such as, e.g., a home 1071, a diary 1072, a short message service (SMS)/multimedia message service (MMS) 1073, an instant message (IM) 1074, a browser 1075, a camera 1076, an alarm 1077, a contact 1078, a voice dial 1079, an email 1080, a calendar 1081, a media player 1082, an album 1083, or a clock 1084. Further, the application 1070 may include a health-care (e.g., measuring the degree of workout or blood sugar), or provision of environmental information (e.g., provision of air pressure, moisture, or temperature information).

According to an embodiment of the present disclosure, the application 1070 may include an application (hereinafter, "information exchanging application" for convenience) supporting information exchange between the electronic device (e.g., the electronic device 101) and an external electronic device (e.g., the electronic devices 102 and 104). Examples of the information exchange application may include, but is not limited to, a notification relay application for transferring specific information to the external electronic device, or a device management application for managing the external electronic device.

For example, the notification relay application may include a function for relaying notification information generated from other applications of the electronic device (e.g., the SMS/MMS application, email application, health-care application, or environmental information application) to the external electronic device (e.g., the electronic devices 102 and 104). Further, the notification relay application may receive notification information from, e.g., the external electronic device and may provide the received notification information to the user. The device management application may perform at least some functions of the external electronic device (e.g., the electronic device 104) communicating with the electronic device (for example, turning on/off the external electronic device (or some components of the external electronic device) or control of brightness (or resolution) of the display), and the device management application may manage (e.g., install, delete, or update) an application operating in the external electronic device or a service (e.g., call service or message service) provided from the external electronic device.

According to an embodiment of the present disclosure, the application 1070 may include an application (e.g., a health-care application) designated depending on the attribute (e.g., as an attribute of the electronic device, the type of electronic device is a mobile medical device) of the external electronic device (e.g., the electronic devices 102 and 104). According to an embodiment of the present disclosure, the application 1070 may include an application received from the external electronic device (e.g., the server 106 or electronic devices 102 and 104). According to an embodiment of the present disclosure, the application 1070 may include a preloaded application or a third party application downloadable from a server. The names of the components of the program module 1010 according to the shown embodiment may be varied depending on the type of operating system.

According to an embodiment of the present disclosure, at least a part of the program module 1010 may be implemented in software, firmware, hardware, or in a combination of two or more thereof. At least a part of the program module 1010 may be implemented (e.g., executed) by e.g., a processor (e.g., the AP 2610). At least a part of the program module 1010 may include e.g., a module, program, routine, set of instructions, process, or the like for performing one or more functions.

The term 'module' or 'functional unit' may refer to a unit including one of hardware, software, and firmware, or a combination thereof. The term 'module' or 'functional unit' may be interchangeably used with a unit, logic, logical block, component, or circuit. The 'module' or 'functional unit' may be a minimum unit or part of an integrated component. The 'module' may be a minimum unit or part of performing one or more functions. The 'module' or 'functional unit' may be implemented mechanically or electronically. For example, the 'module' or 'functional unit' may include at least one of application specific IC (ASIC) chips, Field programmable gate arrays (FPGAs), or programmable logic arrays (PLAs) that perform some operations, which have already been known or will be developed in the future.

According to an embodiment of the present disclosure, at least a part of the device (e.g., modules or their functions) or method (e.g., operations) may be implemented as instructions stored in a computer-readable storage medium e.g., in the form of a program module. The instructions, when executed by a processor (e.g., the processor 120), may enable the processor to carry out a corresponding function. The computer-readable storage medium may be e.g., the memory 130.

The computer-readable storage medium may include a hardware device, such as hard disks, floppy disks, and magnetic tapes (e.g., a magnetic tape), optical media such as compact disc ROMs (CD-ROMs) and DVDs, magneto-optical media such as floptical disks, ROMs, RAMs, flash memories, and/or the like. Examples of the program instructions may include not only machine language codes but also high-level language codes which are executable by various computing means using an interpreter. The aforementioned hardware devices may be configured to operate as one or more software modules to carry out various embodiments of the present disclosure, and vice versa.

Modules or programming modules in accordance with various embodiments of the present disclosure may include at least one or more of the aforementioned components, omit some of them, or further include other additional components. Operations performed by modules, programming modules or other components in accordance with various embodiments of the present disclosure may be carried out sequentially, simultaneously, repeatedly, or heuristically. Furthermore, some of the operations may be performed in a different order, or omitted, or include other additional operation(s).

According to an embodiment of the present disclosure, in a storage medium storing commands, the commands may be ones configured to enable at least one processor to perform at least one operation when executed by the at least one processor, which may include, when a predetermined number or more same frame data are consecutively generated, storing the same frame data in a storage of a display driving module by an AP and stopping transmitting frame data to the display driving module, and scanning frame data stored in the storage and outputting the frame data to a display panel by the display driving module.

According to an embodiment of the present disclosure, in a storage medium storing commands, the commands may be ones configured to enable at least one processor to perform at least one operation when executed by the at least one processor, which may include, when a predetermined number or more same frame data are consecutively generated, setting a display scan frequency and transmitting the same frame data to a display driving module by an AP, when the same frame data are received, transferring a sync signal to the AP whenever outputting the received frame data to a display panel by the display driving module, and transmitting the same frame data to the display driving module according to the display scan frequency by referencing the transferred sync signal until a frame data different from the same frame data is generated by the AP, wherein the number of periods per one second corresponding to the display scan frequency may be smaller than the number of frame data per one second corresponding to the frame rate.

While the present disclosure has been shown and described with reference to various embodiments thereof, it will be understood by those skilled in the art that various changes in form or details may be made therein without departing from the spirit and scope of the present disclosure as defined by the appended claims and their equivalents.

What is claimed is:

1. A method for controlling an electronic device, wherein the electronic device includes an application processor, a display driver module and a display panel, the method comprising:

setting an operation mode of a mobile industry processor interface (MIPI) to a video mode in the electronic device, wherein the application processor outputs frame data to the display panel according to a pre-determined frame rate in the video mode;

generating a first frame data and a second frame data by a graphic processing unit (GPU) of the application processor according to the pre-determined frame rate;

converting the first frame data and the second frame data into a MIPI video packet;

determining whether the first frame data and the second frame data are a same as each other;

in response to the determining that the first frame data and the second frame data are the same as each other, transmitting, a first control signal for activating a panel self refresh (PSR) function in the video mode, and the converted MIPI video packet corresponding to the first frame data and the second frame data to the display driving module, and storing the converted MIPI video packet corresponding to the first frame data and the second frame data in a storage of the display driving module;

turning off a transport port of the application processor and a receive port of the display driving module, wherein a transmission of a clock signal of the MIPI from the application processor to the display driving module is maintained while the PSR function is activated in the video mode;

scanning the storage based on a pre-determined display scan frequency;

decoding the converted MIPI video packet corresponding to the first frame data and the second frame data; and outputting at least one of the first frame data and the second frame data to the display panel according to the pre-determined display scan frequency until receiving, by the display driving module, a second control signal for deactivating the PSR function from the application processor.

2. The method of claim 1, further comprising:

generating third frame data according to the pre-determined frame rate;

storing the third frame data in a buffer; and determining whether any of the third frame data, the first frame data, or the second frame data are a same as each other.

3. The method of claim 2, further comprising:

in response to the determining that any of the third frame data, the first frame data, or the second frame data are not the same as each other, transmitting the second control signal from the application processor to the display driving module; and turning on the transport port of the application processor and the receive port of the display driving module.

4. The method of claim 3, further comprising:

transmitting the third frame data from the application processor to the display driving module;

storing the third frame data in the storage of the display driving module;

scanning the storage of the display driving module based on the pre-determined display frequency; and outputting the third frame data to the display panel.

5. The method of claim 1, wherein a number corresponding to the pre-determined display scan frequency is smaller than a number corresponding to the pre-determined frame rate.

6. An electronic device, comprising:

a display panel;

a display driving module, and an application processor, wherein the application processor is configured to:

set an operation mode of mobile industry processor interface (MIPI) to a video mode in the electronic device, wherein the application processor outputs frame data to the display panel according to a pre-determined frame rate in the video mode;

generate first frame data and second frame data by a graphic processing unit (GPU) of the application processor according to the pre-determined frame rate;

convert the first frame data and the second frame data to MIPI video packet;

determine whether the first frame data and the second frame data are a same as each other;

in response to determining that the first frame data and the second frame data are the same as each other, transmit, a first control signal for activating a panel self refresh (PSR) function in the video mode, and the converted MIPI video packet corresponding to the first frame data and the second frame data to the display driving module;

store the converted MIPI video packet corresponding to the first frame data and the second frame data in a storage of the display driving module;

turn off a transport port of the application processor and a receive port of the display driving module, wherein a transmission of a clock signal of the MIPI from the application processor to the display driving module is maintained while the PSR function is activated in the video mode;

scan the storage based on a pre-determined display scan frequency;

decode the converted MIPI video packet corresponding to the first frame data and the second frame data, and output at least one of the decoded first frame data and second frame data to the display panel according to the pre-determined display scan frequency until receiving, by the display driving module, a second control signal for deactivating the PSR function.

7. The electronic device of claim 6, wherein the application processor is further configured to:

generate third frame data according to the pre-determined frame rate, store the third frame data in a buffer, and determine whether any of the third frame data, the first frame data, or the second frame data are a same as each other.

8. The electronic device of claim 7, wherein the application processor is further configured to:

in response to determining that any of the third frame data, first frame data, or the second frame data are not the same as each other, transmit the second control signal from the application processor to the display driving module, and turn on the transport port of the application processor and the receive port of the display driving module.

9. The electronic device of claim 8, wherein the application processor is further configured to:

transmit the third frame data from the application processor to the display driving module, store the third frame data in the storage of the display driving module, scan the storage of the display driving module based on the pre-determined display scan frequency, and output the third frame data to the display panel.

10. The electronic device of claim 6, wherein a number corresponding to the pre-determined display scan frequency is smaller than a number corresponding to the pre-determined frame rate.

* * * * *